US007408128B2

(12) United States Patent
Watanabe

(10) Patent No.: US 7,408,128 B2
(45) Date of Patent: Aug. 5, 2008

(54) SWITCH APPARATUS AND IMAGE FORMING APPARATUS USING THEREOF

(75) Inventor: Yasunori Watanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 199 days.

(21) Appl. No.: 11/185,883

(22) Filed: Jul. 21, 2005

(65) Prior Publication Data

US 2006/0016680 A1 Jan. 26, 2006

(30) Foreign Application Priority Data

Jul. 21, 2004 (JP) ..... 2004-213065

(51) Int. Cl.
*H01H 3/00* (2006.01)

(52) U.S. Cl. ..... 200/329; 200/293

(58) Field of Classification Search ..... 200/293, 200/329, 330–337, 314–317, 343–345, 332.1
See application file for complete search history.

(56) References Cited

U.S. PATENT DOCUMENTS 4,689,455 A * 8/1987 Watanabe ..... 200/534
4,877,925 A * 10/1989 Kobayashi ..... 200/5 A
5,739,507 A 4/1998 Hochgesang et al.
5,927,483 A * 7/1999 Yamada ..... 200/343
6,392,179 B1 5/2002 Schwarzbich
6,570,111 B2 * 5/2003 Nakagawa et al. ..... 200/343
7,002,086 B2 * 2/2006 Fuji ..... 200/305

FOREIGN PATENT DOCUMENTS

| | | |
|---|---|---|
| DE | 295 09 341 | 8/1995 |
| GB | 2 053 574 | 2/1981 |
| JP | 1-75934 | 5/1989 |

OTHER PUBLICATIONS

European Search report for Application No. 05015795, dated Jul. 10, 2006.

* cited by examiner

*Primary Examiner*—Michael A. Friedhofer
*Assistant Examiner*—Lisa N Klaus
(74) *Attorney, Agent, or Firm*—Banner & Witcoff, Ltd.

(57) ABSTRACT

A switch apparatus includes: a button key being displaceably supported in a pressing direction; a displacement portion being displaced in the pressing direction in interlocking relation to the button key; and a switch being disposed on a downstream side in the pressing direction of the button key. The switch is operable a switching action by being pressed by the displacement portion when the button key is operated by pressing. The displacement portion deviates from the button key with respect to the pressing direction.

20 Claims, 5 Drawing Sheets

SWITCH APPARATUS AND IMAGE FORMING APPARATUS USING THEREOF

BACKGROUND OF THE INVENTION

1. Field of the Invention

The present invention relates to a switch apparatus for effecting a switching action by a user's pressing operation, and also relates to an image forming apparatus using thereof as an operating switch.

2. Description of the Related Arts

Conventionally, a switch apparatus is known which has a button key (key top and stem) for a user to effect a pressing operation, as well as a switch (switch portion) which is disposed below the button key and is turned on by being brought into contact with and pressed by the button key when the button key is operated by being pressed by the user.

In this type of switch apparatus, the switch is disposed immediately below a button key to allow the pressing force of the pressed button key to be applied to the switch so that the switch can be reliably turned on by the user's pressing operation (e.g., refer to JP-UM-A-1-75934).

In the related art, the key top, the stem, and the switch portion in parentheses indicate constituent elements disclosed in JP-UM-A-1-75934, and correspond to the constituent elements of the switch apparatus stated before these parentheses. Namely, the button key corresponds to the key top and the stem in JP-UM-A-1-75934, and the switch corresponds to the switch portion in JP-UM-A-1-75934.

SUMMARY OF THE INVENTION

According to the related-art switch apparatus, although the switching action can be effected reliably in response to the user's pressing operation. Since the pressing force is directly applied to the switch, the load applied to the switch (or the actuating portion) inevitably becomes large, so that the switch is likely to deteriorate.

The invention has been devised to overcome the above-described problem. It is an object to provide a switch apparatus operable the switch through the button key and capable of alleviating the load applied to the switch from the button key during the pressing operation.

According to a first aspect of the invention, a switch apparatus includes: a button key being displaceably supported in a pressing direction; a displacement portion being displaced in the pressing direction in interlocking relation to the button key; and a switch being disposed on a downstream side in the pressing direction of the button key. The switch is operable a switching action by being pressed by the displacement portion when the button key is operated by pressing. The displacement portion deviates from the button key with respect to the pressing direction.

In particular, the displacement portion is disposed at a position offset from the pressing direction with respect to the button key. According to the switch apparatus in the above-described first aspect, the switch apparatus is the same as the conventional switch apparatus in that the pressing operation of the button key causes the switch to be pressed by the displacement portion, thereby effecting a switching operation. However, when the user presses the button key, the switch does not directly receive the pressing force from the user. Hence, it is possible to alleviate the pressing force received by the switch.

According to a second aspect of the invention, the switch apparatus further includes: a plate-shaped key frame being disposed to intersect the pressing direction of the button key, and the plate-shaped key frame supporting an outer edge of the button key. The displacement portion is on the key frame.

According to the above-described second aspect, it is possible to obtain an effect similar to the above-described effect. In this case, the more distant from the button key the position is where the displacement portion is provided in the key frame, the more the load applied to the switch is alleviated.

In addition, in the switch apparatus according to the second aspect, if the key frame is formed integrally with the button key as in the third aspect of the invention, it is possible to reduce the number of parts. Furthermore, if the key frame is formed integrally with not only the button key but the displacement portion, it is possible to further reduce the number of parts.

In a case where the material of the key frame is a rigid material such as wood or metal, it suffices if the weight of the key frame is such that the key frame returns to its initial position persisting prior to the pressing operation by the returning force of the switch after the completion of the user's pressing operation. In this case, however, since the switch must return the key frame to the initial position by its own returning force, the load applied to the switch inevitably becomes large.

Accordingly, to prevent this problem, it suffices if the key frame is provided with a spring for imparting a force in the direction of the returning force of the switch. If such an arrangement is provided, the number of parts undesirably increases.

Accordingly, to overcome such a problem, as in a fourth aspect of the invention, the key frame is preferably formed of a flexible material.

According to the above-described construction, upon completion of the pressing operation by the user, a restoring force acts in the key frame in the deflected state, so that the key frame returns to its initial position by virtue of that restoring force. For this reason, in accordance with the switch apparatus according to the fourth aspect, it is possible to alleviate the load applied to the switch without increasing the number of parts. In addition, since the key frame is formed of a flexible material, if the user has pressed the button key, the key frame is deflected starting with its portion where the button key is disposed and then proceeding to the displacement portion. Therefore, it is possible to alleviate the pressing force from the user by the key frame, and effectively mitigate the load applied to the switch.

In addition, in the switch apparatus according to the fourth aspect, if the material of the key frame is a flexible resin as in the fifth aspect of the invention, the key frame can be easily formed by injection molding.

Next, in accordance with the switch apparatus according to a sixth aspect of the invention, in the switch apparatus according to the fourth or fifth aspect, the key frame has a first notch for separating between the button key and the displacement portion.

According to the above-described construction, since the button key and the displacement portion are separated by the first notch, it is possible to more effectively alleviate the pressing force received by the switch when the button key is operated by pressing.

In addition, in the switch apparatus according to any one of the fourth to sixth aspects, if the key frame is supported at at least three points around the button key in the key frame as in a seventh aspect of the invention, the key frame can be supported in a stable state.

In the switch apparatus according to any one of the fourth to sixth aspects, the key frame may be supported so as to be lifted or lowered or to rotate in response to the pressing operation of the button key by the user.

According to a eight aspect of the invention, the switch apparatus further includes: a plate-shaped supporting frame being disposed on the downstream side in the pressing direction of the button key so as to oppose the key frame; a shaft portion being provided at one end of the key frame; a receiving portion being provided on the supporting frame, and the receiving portion receiving both ends of the shaft portion to rotatably support the key frame at an interval with the supporting frame; and a supporting column being provided on at least one of the key frame and the supporting frame, and the supporting column supporting the key frame at an interval with the supporting frame at an opposite side to the shaft portion with respect to the button key.

In the case where the key frame is supported so as to be rotatable, it suffices if the switch apparatus is constructed as in the eighth aspect of the invention.

According to the above-described construction, the key frame becomes rotatable in response to the user's pressing operation. Further, the supporting frame is capable of supporting the key frame in a stable state.

Furthermore, in the switch apparatus according to any one of the fourth to eighth aspects, the key frame may have formed therein a second notch along an outer periphery of the button key as in a ninth aspect of the invention.

According to the above-described construction, it is possible to enlarge the stroke of the button key during the pressing operation, thereby making it possible to impart an operating feel to the user.

In addition, in the switch apparatus according to the ninth aspect, the second notch is preferably formed by notching the outer periphery of the button key by at least a half circumference as in a 10th aspect of the invention.

According to the above-described construction, it is possible to impart a more appropriate operating feel to the user.

In addition, in the switch apparatus according to any one of the eighth to 10th aspects, the switch is preferably pressed by the displacement portion when the key frame has abutted against the supporting frame as in an 11th aspect of the invention. Namely, the position at which the switch is pressed by the displacement portion is determined so that the switch effects the switching action when the key frame has abutted against the supporting frame.

According to the above-described construction, it is possible to limit the pressing force which is applied to the switch by the key frame. Hence, no matter how strong a force the user applies in pressing the button key, the switch is not broken.

According to the above-aspects of the invention, the switch apparatus is applicable to any apparatus having a switch for operation. For example, as in a 12th aspect of the invention, the switch apparatus of the above-aspects can also be applied to an image forming apparatus for forming an image on a recording medium on the basis of image data received from an outside or image data obtained by reading an original.

In the case where the switch apparatus of the above-aspects is applied to an image forming apparatus, the switch apparatus is capable of alleviating the load applied to the switch when it is operated by pressing. Therefore, it is possible to prolong the life of the switch apparatus and, hence, the life of the image forming apparatus.

BRIEF DESCRIPTION OF THE DRAWINGS

These and other objects and advantages of this invention will become more fully apparent from the following detailed description taken with the accompanying drawings in which:

FIGS. 3A and 3B are explanatory diagrams for explaining a key frame 5, in which FIG. 3A is a perspective view thereof, and FIG. 3B is a plan view thereof;

FIGS. 4A to 4C are explanatory diagrams for explaining the switch apparatus, in which FIG. 4A is a plan view, FIG. 4B is a cross-sectional view taken along line A-A in FIG. 4A, and FIG. 4C is a cross-sectional view taken along line B-B in FIG. 4A.

DESCRIPTION OF THE PREFERRED EMBODIMENTS

Figure 1:
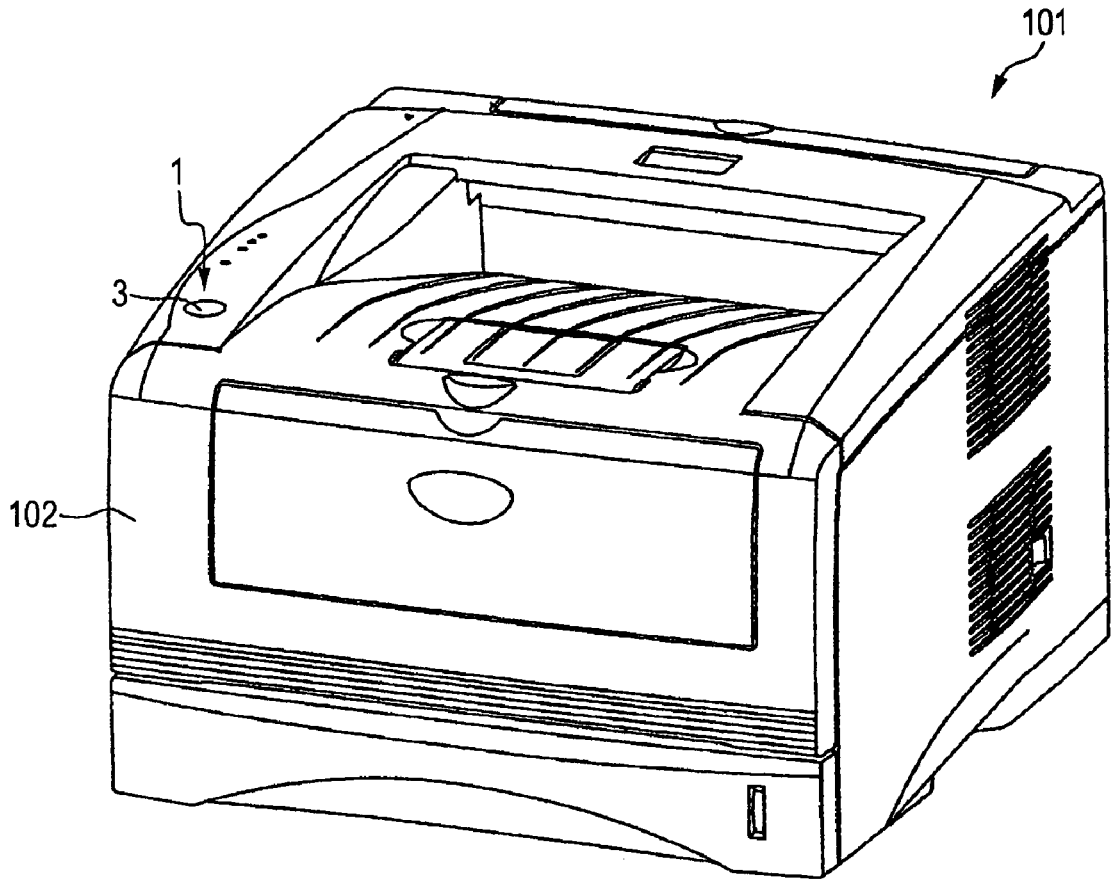
FIG. 1 is a perspective view illustrating the appearance of a printer having a switch apparatus in accordance with an embodiment.

Hereafter, referring to the drawings, a description will be given of a switch apparatus of the embodiments. The switch apparatus of this embodiment is applied to a printer 101 (an image forming apparatus), such as the one shown in FIG. 1, as a switch for its operation, and is a switch for a user to perform input operations such as a print start and a print stop, for example.

FIG. 1 is a perspective view illustrating the appearance of the printer 101 having a switch apparatus 1 in accordance with this embodiment. In addition, the printer 101 has inside its housing 102 a scanner unit for applying laser light, a photoconductive drum for forming an electrostatic latent image with the laser light applied from the scanner unit, a development roller for developing the electrostatic latent image formed on the photoconductive drum with a developer to form a visible image, a transfer roller for transferring onto a recording medium the visible image formed on the photoconductive drum by the development roller, a fixing roller for fixing on the recording medium the visible image transferred onto the recording medium by the transfer roller, and so on.

The switch apparatus 1 is for effecting a switching action in response to the user's pressing operation, and is incorporated in the housing 102 of the printer 101, as shown in FIG. 1. An upper surface of a button key 3 to be described later, which is pressed by the user for operation, is exposed on the upper surface of the printer 101.

Figure 2:
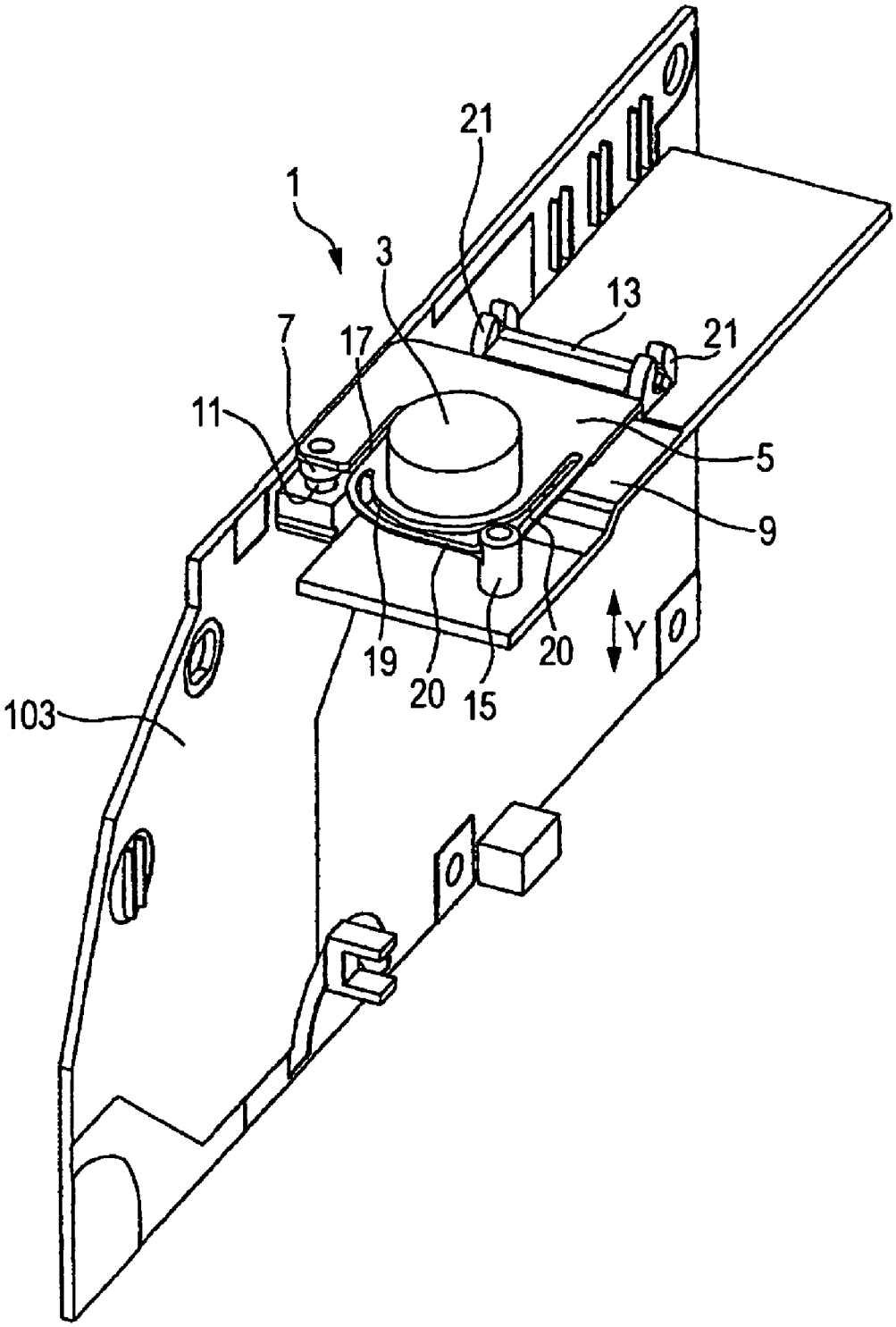
FIG. 2 is a perspective view of the switch apparatus of the embodiment.

As shown in FIG. 2, the switch apparatus 1 includes the cylindrical button key 3 which is disposed inside the housing 102 of the printer 101 and is displaced in response to the user's pressing operation; a plate-shaped key frame 5 for supporting an outer edge of the bottom surface of the button key 3; a cylindrical displacement portion 7 which, of the surfaces of the key frame 5, is formed on the opposite surface (i.e., the bottom-side surface of the printer 101) to the surface where the button key 3 is formed, and which, in an interlocking relation to the button key 3 operated by pressing, is displaced in its pressing direction Y; a plate-shaped supporting frame 9 disposed closer to the bottom side of the printer 101 than the key frame 5 and adapted to support the key frame 5; and a switch 11 disposed closer to the bottom side of the printer 101 than the key frame 5 and adapted to effect a switching action by being pressed by the displacement portion 7 when the button key 3 is operated by pressing. Namely, the switch 11 in the switch apparatus 1 of the embodiment is a contact-type switch which is operated by coming into contact with the displacement portion 7.

It should be noted that FIG. 2 is a perspective view of the switch apparatus 1. In addition, the supporting frame 9 and the switch 11 are mounted on a substrate 103 provided on a side surface inside the housing 102 of the printer 101.

The key frame 5 is formed integrally with the button key 3 and the displacement portion 7 and is formed of a flexible resin (e.g., ABS resin). The displacement portion 7 is formed on the key frame 5 closer to the substrate 103 side than the button key 3.

Figure 3A:
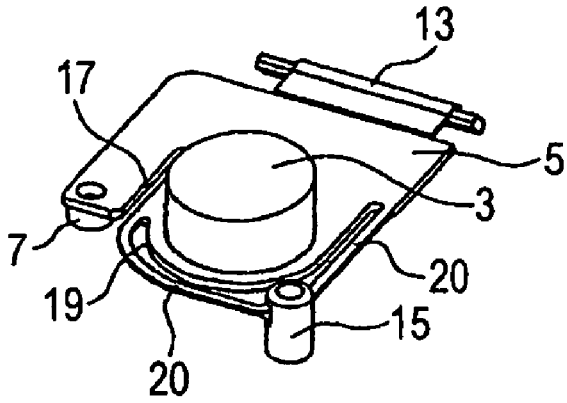
Figure 3B:
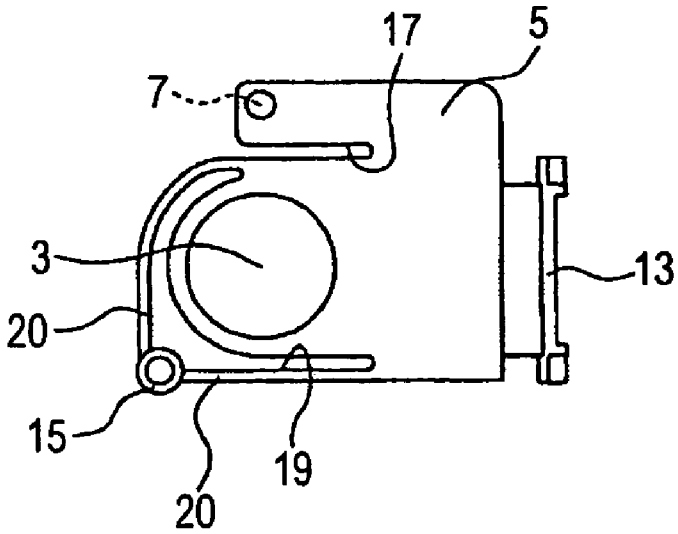

As shown in FIGS. 3A and 3B, a shaft portion 13 is formed at one end of the key frame 5 along the key frame 5 in parallel with the direction in which the button key 3 and the displacement portion 7 are juxtaposed. It should be noted that FIGS. 3A and 3B are explanatory diagrams for explaining the key frame 5, in which FIG. 3A is a perspective view thereof, and FIG. 3B is a plan view thereof.

In addition, a cylindrical supporting column 15 for supporting the key frame 5 at an interval with the supporting frame 9 is formed at that end of the key frame 5 which is away from the shaft portion 13 side with respect to the button key 3 and which is away from the displacement portion 7 side with respect to the button key 3.

Further, the key frame 5 has formed therein a first notch 17 for separating between the button key 3 and the displacement portion 7, as well as a second notch 19 formed by notching the supporting column 15 side of its portion along the outer periphery of the button key 3 by a half circumference or thereabouts. Namely, the second notch 19 is one in which a half length of the circumference surrounding the button key 3 is notched.

As a result, of the outer edges of the key frame 5, an edge portion 20 which extends along the second notch 19 becomes a portion which practically does not receive the pressing force applied to the button key 3 by the user's pressing operation. It should be noted that, of the outer edges of this key frame 5, the edge portion 20 extending along the second notch 19 will be referred to as the arm portion 20.

In addition, the key frame 5 is disposed at a predetermined interval with respect to the upper surface of the supporting frame 9 (i.e., the surface on the key frame 5 side). That interval is of such a degree that the displacement portion 7 presses the switch 11 when the surface on the displacement portion 7 side of the key frame 5 has abutted against the supporting frame 9 as the button key 3 is operated by pressing.

Figure 4A:
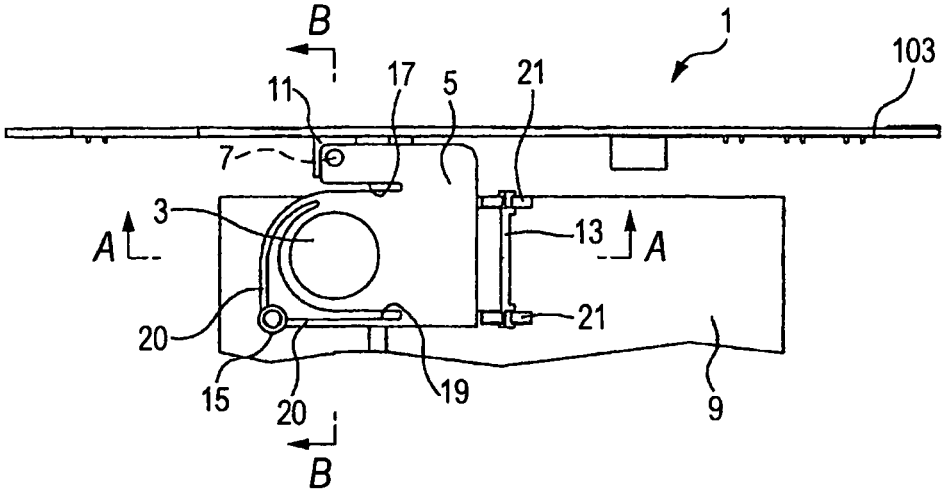
Figure 4B:
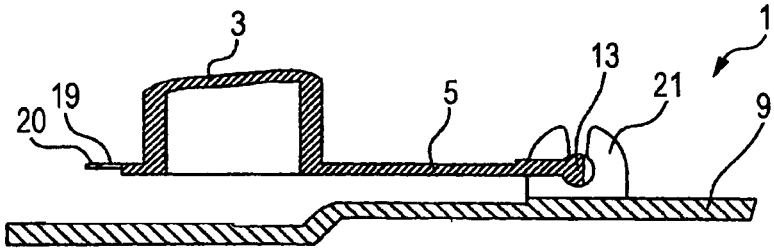
Figure 4C:
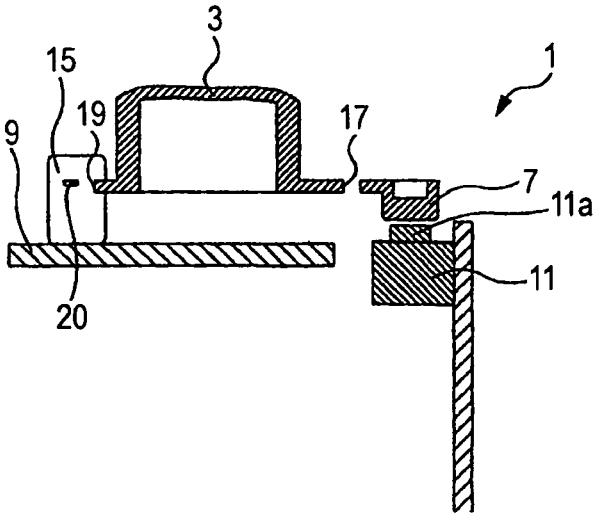

Meanwhile, as shown in FIGS. 4A to 4C, a pair of receiving portions 21 are formed on the supporting frame 9 so as to rotatably support the key frame 5 at an interval with the supporting frame 9 by receiving both ends of the shaft portion 13. It should be noted that FIGS. 4A to 4C are explanatory diagrams for explaining the switch apparatus 1, in which FIG. 4A is a plan view, FIG. 4B is a cross-sectional view taken along line A-A in FIG. 4A, and FIG. 4C is a cross-sectional view taken along line B-B in FIG. 4A.

As shown in FIG. 4B, each of the receiving portions 21 has a slot which is formed in such a manner as to extend from its end on the upper surface side of the printer 101 toward its interior such that the key frame 5 becomes detachable.

As shown in FIG. 4C, the switch 11 has a button portion 11*a* for effecting a switching action by being pressed by the displacement portion 7. The button portion 11*a*, if not kept pressed, is automatically reset and returns to its initial position.

In addition, the switch 11 is disposed at a predetermined interval with respect to the bottom surface (the surface on the switch 11 side) of the displacement portion 7 before the pressing operation, as shown in FIG. 4C.

Next, referring to FIGS. 5A and 5B, a description will be given of the operation of the switch apparatus 1 in accordance with this embodiment.

Figure 5A:
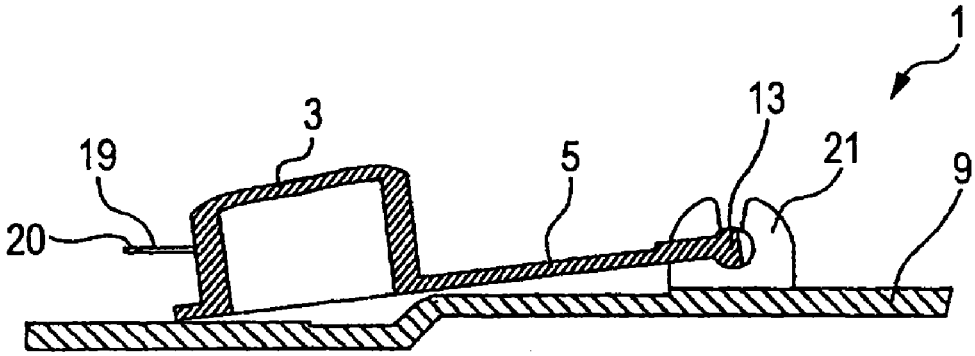
FIGS. 5A and 5B are diagrams for explaining the action of the switch apparatus.
Figure 5B:
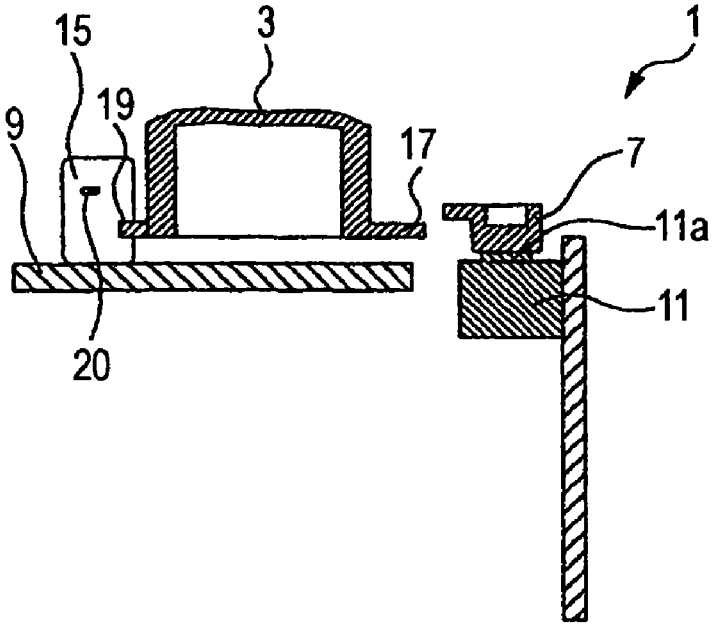

First, if the button key 3 is operated by pressing by the user (e.g., if the user presses the button key 3 with his or her finger), the portion on the shaft portion 13 side of the key frame 5 as demarcated by the second notch 19 with the arm portion 20 left rotates toward the supporting frame 9 side (the bottom side of the printer 101) while being deflected by the user's pressing force, as shown in FIG. 5A. At this time, the portion on the displacement portion 7 side of the key frame 5 as demarcated by the first notch 17 also rotates in the same direction by following the portion on the shaft portion 13 side of the key frame 5 as demarcated by the second notch 19.

Further, if the button key 3 is operated by pressing until, of the surfaces of the key frame 5, the surface on the displacement portion 7 side abuts against the supporting frame 9, the displacement portion 7 which came into contact with the button portion 11*a* by the rotating action of the key frame 5 presses the switch (specifically, the button portion 11*a*).

Then, the switch 11 effects the switching action.

If the user ceases to press the button key 3 (if the user who pressed the button key 3 with his or her finger releases the finger), the key frame 5 in the deflected state returns to its initial position persisting prior to the deflection by virtue of its own restoring force. For this reason, the button portion 11*a* of the switch 11 which was in the state of being pressed by the displacement portion 7 also returns to its initial position persisting prior to the pressing by virtue of its own restoring force.

According to the switch apparatus 1 of the above-described embodiment, since the displacement portion 7 is at a position offset from the button key 3 in the pressing direction Y of the button key 3, when the user has pressed the button key 3, the switch 11 does not directly receive the user's pressing force, so that it is possible to alleviate the pressing force received by the switch 11. Namely, since the button key 3 and the displacement portion 7 do not overlap in the plan view in FIG. 4A, the pressing force from the user is transmitted to the switch 11 after it is alleviated.

In addition, since the button key 3 and the displacement portion 7 are separated by the first notch 17, it is possible to more effectively alleviate the pressing force received by the switch 11 when the button key 3 is operated by pressing.

In addition, since the second notch 19 is formed in the key frame 5, it is possible to enlarge the stroke of the button key 3 during the pressing operation, thereby making it possible to impart an operating feel to the user.

Furthermore, in this switch apparatus 1, the position at which the switch 11 is pressed by the displacement portion 7 is determined so that the switch 11 effects the switching action when the key frame 5 has abutted against the supporting frame 9. Therefore, it is possible to limit the pressing force which is applied to the switch 11. Hence, no matter how strong a force the user applies in pressing the button key 3, the switch 11 is not broken.

In addition, since the key frame 5 can be removed from the supporting frame 9 (the receiving portion 21), the user is able to change the key frame 5 to another key frame colored to the user's favorite color.

Although a description has been given above of one embodiment of the invention, it goes without saying that various forms can be adopted in the invention.

Although in this embodiment the switch 11 is disposed at an interval with the displacement portion 7, the switch 11 may abut against the displacement portion 7 in advance. In this case, the load which is imparted by the displacement portion 7 to the switch 11 is sufficient if it is of such a degree as not to cause a switching action in the initial state in which the button key 3 is not operated by pressing.

In addition, the displacement portion 7 may not be formed in the key frame 5. In this case, since the key frame 5 presses the switch 11, that pressing portion corresponds to the displacement portion.

In addition, the material of the key frame 5 is not limited to the resin, and may be a rigid material such as wood or metal. In this case, it suffices if the weight of the key frame 5 is such that the key frame 5 returns to its initial position persisting prior to the pressing operation by the returning force of the switch 11 after the completion of the user's pressing operation. Furthermore, if the switch apparatus of this modification has a spring for imparting a force to the key frame 5 in the direction of the returning force of the switch 11, it is possible to alleviate the load applied to the switch 11.

However, the switch apparatus 1 of this embodiment is more advantageous than the switch apparatus of this modification in that it is possible to alleviate the load which is applied to the switch 11 without increasing the number of parts.

In addition, although in this embodiment the shaft portion 13 is provided on the key frame 5, and the receiving portions 21 for receiving the shaft portion 13 are provided on the supporting frame 9, the invention is not limited to the same, and the receiving portions 21 may be provided on the key frame 5, and the shaft portion 13 may be provided on the supporting frame 9. If such a construction is provided, the key frame 5 is able to rotate by using the shaft portion 13 as an axis.

In addition, although the switch apparatus 1 is applied as a switch for operating the printer 101, the invention is not limited to the same, and the switch apparatus 1 may be applied as a switch for operating a keyboard of a personal computer, for example.

What is claimed is:

1. A switch apparatus comprising:

a button key displaceably supported in a pressing direction;

a displacement portion in interlocking relation to the button key and configured to be displaced in the pressing direction;

a switch configured to be pressed by the displacement portion when the button key is operated by pressing; and a key frame disposed to intersect the pressing direction of the button key, and the key frame supporting an outer edge of the button key;

wherein the displacement portion is on the key frame and at a position offset from the button key with respect to the pressing direction, and the key frame as a first notch for separating the button key and the displacement portion.

2. The switch apparatus according to claim 1, wherein the key frame is plate-shaped.

3. The switch apparatus according to claim 1, wherein the key frame is formed integrally with the button key.

4. The switch apparatus according to claim 1, wherein the key frame is formed of a flexible material.

5. The switch apparatus according to claim 4, wherein the flexible material is a flexible resin.

6. The switch apparatus according to claim 1, wherein the key frame has a second notch along an outer periphery of the button key.

7. The switch apparatus according to claim 6, wherein the second notch extends around the outer periphery of the button key by at least a half circumference.

8. The switch apparatus according to claim 1, wherein the key frame is supported at three or more points around the button key.

9. The switch apparatus according to claim 1, wherein the switch is pressed by the displacement portion when the key frame abuts against the supporting frame.

10. A switch apparatus comprising:

a button key displaceably supported in a pressing direction;

a displacement portion in interlocking relation to the button key and configured to be displaced in the pressing direction;

a switch configured to be pressed by the displacement potion when the button key is operated by pressing;

a plate-shaped key frame disposed to intersect the pressing direction of the button key, and the plate-shaped key frame supporting an outer edge of the button key;

a plate-shaped supporting frame disposed in the pressing direction of the button key so as to oppose the key frame;

a shaft portion provided at one end of the key frame;

a receiving portion provided on the supporting frame, and receiving both ends of the shaft portion to rotatably support the key frame at an interval with the supporting frame; and a supporting column provided on at least one of the key frame and the supporting frame, and the supporting column supporting the key frame at an interval with the supporting frame at an opposite side to the shaft portion with respect to the button key, wherein the displacement portion is on the key frame and at a position offset from the button key with respect to the pressing direction.

11. The switch apparatus according to claim 10, wherein the key frame has a first notch along an outer periphery of the button key.

12. The switch apparatus according to claim 11, wherein the first notch extends around the outer periphery of the button key by at least a half circumference.

13. The switch apparatus according to claim 10, wherein the switch is pressed by the displacement portion when the key frame abuts against the supporting frame.

14. The switch apparatus according to claim 10, wherein the key frame is formed integrally with the button key.

15. The switch apparatus according to claim 10, wherein the key frame is formed of a flexible material.

16. The switch apparatus according to claim 15, wherein the flexible material is a flexible resin.

17. The switch apparatus according to claim 10, wherein the key frame has a second notch along an outer periphery of the button key.

18. The switch apparatus according to claim 10, wherein the key frame is supported at three or more points around the button key.

19. An image forming apparatus for forming an image on a recording medium on the basis of image data received from an outside or image data obtained by reading an original, comprising:

a switch apparatus for operating the image forming apparatus;

wherein the switch apparatus comprises:

a button key displaceably supported in a pressing direction;

a displacement portion in interlocking relation to the button key and configured to be displaced in the pressing direction;

a switch configured to be pressed by the displacement portion when the button key is operated by pressing; and a plate-shaped key frame disposed to intersect the pressing direction of the button key, and the plate-shaped key frame supporting an outer edge of the button key;

wherein the displacement portion is on the key frame and at a position offset from the button key with respect to the pressing direction and the key frame has a first notch for separating the button key and the displacement portion.

20. The image forming apparatus according claim 19, wherein the key frame is plate-shaped.

* * * * *

UNITED STATES PATENT AND TRADEMARK OFFICE

CERTIFICATE OF CORRECTION

PATENT NO. : 7,408,128 B2
APPLICATION NO. : 11/185883
DATED : August 5, 2008
INVENTOR(S) : Yasunori Watanabe It is certified that error appears in the above-identified patent and that said Letters Patent is hereby corrected as shown below:

Column 8, Claim 10, Line 10:
Please replace "potion when the button key is" with --portion when the button key is--.

Signed and Sealed this

Twenty-sixth Day of May, 2009

JOHN DOLL
*Acting Director of the United States Patent and Trademark Office*